United States Patent [19]

Cihanek

[11] Patent Number: 4,729,184

[45] Date of Patent: Mar. 8, 1988

[54] CHANGEABLE DIGITAL DISPLAY DEVICE

[76] Inventor: Lawrence Cihanek, Dixon Rd., Carmel, N.Y. 10512

[21] Appl. No.: 852,757

[22] Filed: Apr. 16, 1986

[51] Int. Cl.[4] ..... G09F 3/04

[52] U.S. Cl. ..... 40/450; 40/447; 40/486

[58] Field of Search ..... 40/446, 447, 450, 486, 40/487, 488

[56] References Cited

U.S. PATENT DOCUMENTS

| | | | |
|---|---|---|---|
| 384,431 | 6/1888 | Dunham | 40/487 |
| 1,257,989 | 3/1918 | Ewing | 40/486 |
| 1,952,920 | 3/1934 | Hudiakoff | 40/446 |
| 2,120,418 | 6/1938 | Sorensen | 40/612 |
| 3,296,726 | 1/1967 | Hill | 40/447 |
| 4,164,824 | 8/1979 | Nidelkoff | 40/450 |
| 4,220,948 | 9/1980 | Trame | 40/450 |
| 4,507,886 | 4/1985 | Streeter et al. | 40/450 |
| 4,509,279 | 4/1985 | Greenberger | 40/450 |
| 4,539,768 | 9/1985 | Halliday | 40/450 |
| 4,542,603 | 9/1985 | Streeter et al. | 40/450 |

FOREIGN PATENT DOCUMENTS

| | | | |
|---|---|---|---|
| 25082 | 9/1919 | Denmark | 40/447 |
| 8527079 | 10/1985 | Fed. Rep. of Germany | 40/450 |
| 23294 | 3/1978 | Japan | 40/451 |
| 2139391 | 11/1984 | United Kingdom | 40/450 |

*Primary Examiner*—Carl D. Friedman
*Assistant Examiner*—Michael Safavi

[57] ABSTRACT

A manually changeable digital display device capable of displaying the numerals zero through 9 comprises a background panel having an optic or brightly colored face and a one-piece foreground panel adjacent to and parallel with the background panel. The one-piece foreground panel has seven elongated windows or openings which expose seven corresponding segments of the background panel. Each of the windows is covered by a flap which is integrally formed with the foreground panel and is hinged thereto. The desired numerals are formed by opening and closing the appropriate flaps to expose the appropriate corresponding segments thereby displaying the desired numerals. Two or more such digital display units can be arranged side by side to display the numerals 10 through any desired number.

7 Claims, 6 Drawing Figures

CHANGEABLE DIGITAL DISPLAY DEVICE

FIELD OF THE INVENTION

This invention relates to a digital display device and is particularly related to a manually changeable digital display device for displaying different numerals.

BACKGROUND OF THE INVENTION

At the present time, display devices which display numbers may require that the numbers be changed frequently or from time to time; for example, a bank window will display, in numbers, the current interest rates being paid on various types of deposits at various types of loans and mortgages. The rates may change weekly or even daily. In one type of commercially available display device, the numbers 0 through 9 are printed on a plastic roll and the roll is then rotated to expose, in a frame, the desired numbers. In another type of display a frame receives a flat card having printed thereon one of the numbers 1 through 9.

A similar type of flat card system is used in other locations where prices or rates change periodically; for example, the price displays used at gasoline stations, stores and by cigarette vendors. However, the cards are easily lost or damaged, and when they become damaged, they may not fit in their frames. When a gas station wishes to change its prices for "regular leaded", "unleaded", "high-test unleaded" and "diesel", 12 separate numbers must be changed, which is time consuming and may be particularly difficult if the number cards are bent or misplaced.

It is therefore an object of this invention to provide a display device which may be readily and easily changed, by hand, in order to display the numerals 0 through 9; so that a row of such devices can show prices or rates, and may be rapidly changed to reflect the rapidly changing rates or prices.

It is a further object of the present invention to provide such a display device which is relatively rugged and durable, so that the numbers may be changed on the display device many times without damage to its structural integrity.

It is another object of the present invention to provide such a display device which may be produced, at relatively low cost, using conventional plastic molding or other suitable processes and conventional plastic resins.

It is still a further object of the present invention to provide such a display device which will have the appearance of a digital type electronic display and yet will be non-electronic so that it may be relatively brighter, less expensive and more durable compared to an electronic display of the same size.

It is a feature of the present invention to provide a display device which may be manually and easily changed to display the numerals 0 through 9. Three of the display devices may be formed, or mounted, side-by-side, to display the numbers 0 through 999.

SUMMARY OF THE INVENTION

The display device comprises a background panel; preferably having an optic or a brightly colored face. A one-piece foreground panel is attached adjacent to and parallel with the background panel. The foreground panel is provided with seven cut-out elongated portions which expose seven corresponding elongated segments of the background panel. Three of the exposed segments are parallel, horizontally aligned and evenly spaced apart and the other four exposed segments are aligned vertically in two opposite pairs to form (with the three horizontal exposed segments) the number "8" in block digital appearance.

The one-piece foreground panel is flexible and can be made of a resilient plastic resin, preferably polypropylene, and includes seven elongated flap portions. Each of the flap portions is integrally hinged to said foreground panel, preferably by a thin section of the panel, and is sized and shaped to cover a respective one of the exposed segments.

The display device may also include means to retain each of the flaps in a closed position (covering its respective exposed segment) and means to retain each of said flaps in an open position (exposing its respective exposed segment).

Preferably each of the exposed segments may be trapezoidal with inwardly directed opposite short-side ends, with the inward direction being toward the centers of the numeral "8". Also, preferably, the edges of the exposed segments are parallel and closely spaced together.

BRIEF DESCRIPTION OF THE DRAWINGS

Other objects and features of the present invention will become more apparent from the following detailed description of the invention, taken in conjunction with the accompanying drawings, wherein.

DETAILED DESCRIPTION OF THE INVENTION

Figure 1:
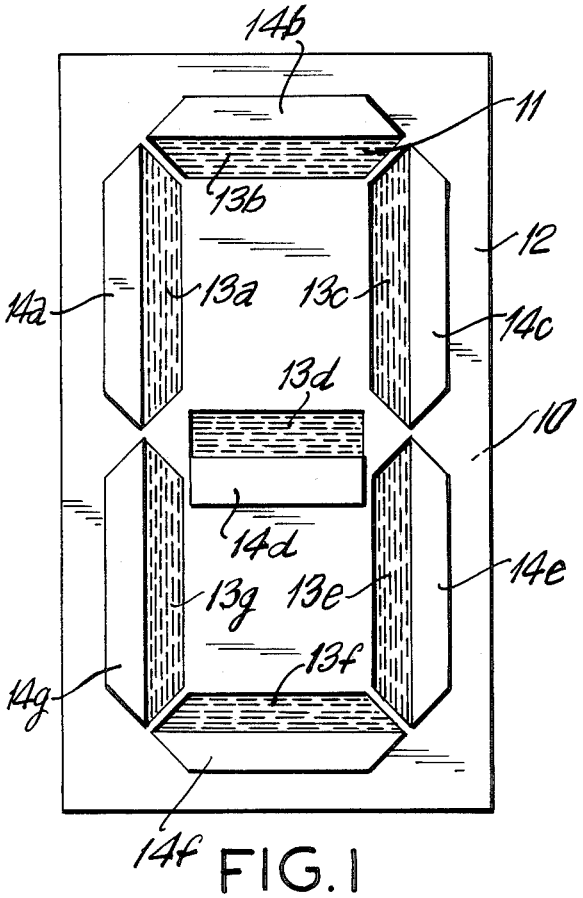
FIG. 1 is a top plan view of one embodiment of the present invention.

With reference to FIG. 1, the digital device of this invention is shown to comprise a background panel 10 (back panel) having an optic or brightly colored face 11 adjacently attached to, and in parallel with a one-piece foreground panel 12 (front panel). The front face 11 of the back panel is of contrasting color, and may be conveniently bright or highly visible in color such as fluorescent green, optic yellow or red.

Panels 10 and 12 may be made of plastic resin or some other suitable material. The front panel is preferably injection molded of a plastic resin which is flexible and resilient, an example of such suitable plastic resin being polypropylene. The back panel 10 is preferably made of a commercially available sheet of a plastic resin, for example 1/16th of inch in thickness, so that it is self-supporting and relatively stiff, and may be made of polyethylene, polystyrene or some other suitable material.

The front panel 12 has seven elongated windows or openings 13*a*–13*g* cut-therein. The openings 13*b*, 13*d* and 13*f* are horizontal, spaced apart and parallel to each other. The openings 13*a* and 13*c* form one pair of vertically aligned openings and the openings 13*g* and 13*e* form a second pair of vertically aligned openings. The openings 13*a*–13*g* form the number "8" in block digital appearance Preferably each opening 13*a*–13*g* is of generally trapezoidal configuration with the inner side, i.e., the shorter sides angled inward toward the center of the number "8".

The front panel 12 (foreground panel) has a series of flaps integrally hinged to the panel 12. The flaps 14*a*–14*g* are preferably hinged by thin sections of panel, this type of hinge in polypropylene being generally known as the "Living Hinge." It may be flexed many thousands of times without impairing its structural integrity.

Figure 2:
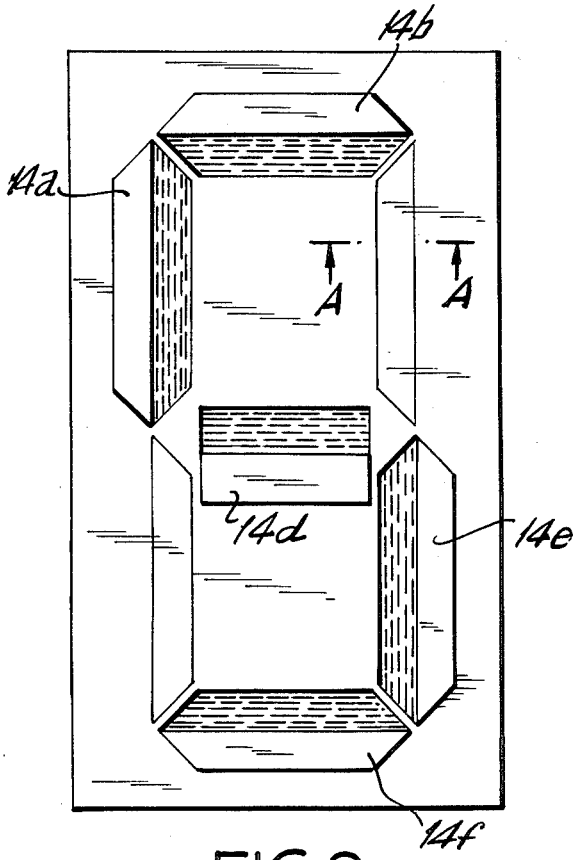
FIG. 2 is a top plan view, similar to FIG. 1 but with some of the flaps in their open position to display the numeral 5.

Each of the flaps 14*a*–14*g* may cover one of the exposed openings 13*a*–13*g*. When flaps are down, the openings 13*a*–13*g* are covered and not visible. However, when the flaps are opened, the openings 13*a*–13*g* are exposed. To form the number "1", the flaps 13*a* and 13*g* are opened and the remaining flaps are closed. To form the number "5", as shown in FIG. 2, the flaps 14*a*, 14*b*, 14*d*, 14*e* and 14*f* are opened only. In a similar manner each of the numbers 0–9 may be displayed by opening the appropriate flaps in order to expose the correct segment.

Each of the flaps are retained in their open and closed positions by interfitting integral configurations on the flap (or the hinge) and the foreground panel. Such interfitting integral engagement may be achieved by, for example, forming, during molding, a button-shaped snap on the face of the flap and a corresponding recess or indentation in the front panel for interfitting engagement of the button-shaped snap into said recess when the flap is opened to expose a corresponding segment in the background panel.

Figure 3:
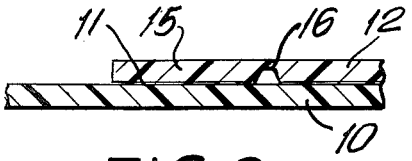
FIG. 3 is an enlarged cross-sectional view taken along line A—A of FIG. 2 and looking in the direction of the arrows.

In the embodiment shown in FIG. 3, the flap 15 (corresponding to one of the flaps 14*a*–14*g*) is connected to the body portion of the panel 12 by the integral hinge 16, which is a thin portion connecting flap 15 to the panel 12.

Figure 4:
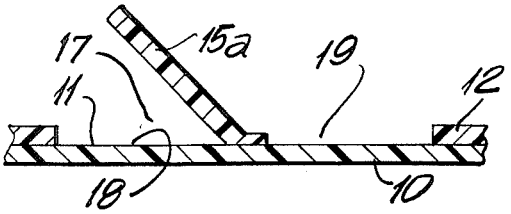
FIG. 4 is an enlarged cross-sectional view of an alternate flap construction.

In the embodiment shown in FIG. 4, the flap 15*a* (corresponding to one of the flaps 14*a*–14*g*) fits into a cut-out segment of the front panel 11 in a cavity 19 in which the flap 15*a* is fitted when the segment 18 is exposed.

Figure 5:
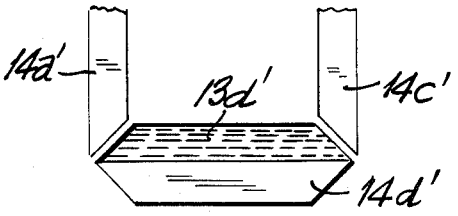
FIG. 5 is a top plan view of an alternative central portion of FIG. 1 illustrating different configuration of the flaps.

FIG. 5 shows an alternative shape of the horizontal central exposed segment 13*d* and its flap 14*d*.

Figure 6:
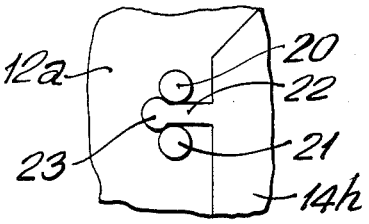
FIG. 6 is an enlarged top plan view of a retaining means for a flap.

FIG. 6 illustrates another embodiment of a means for removably holding the flap to the front panel. The front panel 12*a* in this embodiment has two upstanding bosses (posts) 20 and 21 in front of the flap 14*h* and another two bosses or posts (not shown) behind the flap 14*h*. A stem 22 having a knob 23 at its end is integral with the flap 14*h*. The bosses 20 and 21 are separated by the stem 22 and retain the knob 23 so that the flap may be lifted, by hand, when the flap position is to be changed. Other types of retaining means may alternatively be used, such as interlocking fabric with hooks (Velcro ®, self-adhesive stripes (Scotch Post-It trademark of 3M company.)

Each of the flaps have two retaining means, one to keep it open and one to keep it closed. The retaining means are readily released by the hand of the user to change the position of the flap.

The display device of this invention may be used to display from 0 to any desired number. For example, when it is desired to display numerals of 10 or higher, the foreground panel will comprise a series of cut-out portions and flaps arranged in rows to form 2 or more figure "8". In this manner, the first row may be used to form one digit, say 7, and the second row may be used to form another digit, say 6, to display the numeral "76". As may rows may be used as is necessary to display any desired number such as "895", "1101" and so on.

While the invention has been described and illustrated with a certain degree of particularity in order to facilitate its understanding, it must be understood that numerous changes and modifications will be suggested by the present description. Such changes and modifications are obvious from the foregoing description and are therefore within the scope of this invention.

What is claimed is:

1. A manually alterable digital display device for displaying zero and each of the numerals 1 through 9, said device comprising:

(a) a panel having seven cut-out portions, three of said cut-out portions being parallel, horizontally aligned and evenly spaced apart; the remaining four cut-out portions being aligned vertically in two opposite pairs to form with said three horizontal cut-out portions the numeral "8" in block digital appearance;

(b) seven elongated flaps formed as part of said panel so as to form one piece with said panel, each of said flaps having a free edge and an opposite edge forming a hinge within the panel, said flap being positioned as well as having a size and configuration to cover a corresponding one of said seven cut-out portions, and (c) an integral retaining means for retaining each of said flaps in open position when exposing each of said cut-out portions.

2. A device as in claim 1 wherein each of said cut-out portions has the general configuration of a trapezoid having inwardly directed opposite short-side ends, with the inward direction being toward the centers of the number "8".

3. A device as in claim 2 wherein the edges of said cut-out portions are parallel and closely spaced apart.

4. A device as in claim 1 wherein said panel is made of flexible plastic material.

5. A device as in claim 2 wherein said panel is made of a flexible plastic material.

6. A device as in claim 3 wherein said panel is made of a flexible plastic material.

7. A device as in claim 1, wherein said panel comprises a series of said cut-out portions and flaps arranged in rows so as to form at least two figure "8" so that said device can display 0 and any desired numeral.

* * * * *